US007044792B1

(12) United States Patent
Chen et al.

(10) Patent No.: US 7,044,792 B1
(45) Date of Patent: May 16, 2006

(54) SHIELD AND ELECTRICAL CONNECTOR WITH THE SHIELD

(75) Inventors: Ping-Chih Chen, Taipei Hsien (TW); Mao Jung Huang, Taipei Hsien (TW); Te-Hung Yin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/150,693

(22) Filed: Jun. 11, 2005

(51) Int. Cl.
*H01R 13/648* (2006.01)

(52) U.S. Cl. ..... 439/607

(58) Field of Classification Search ..... 439/607, 439/939, 608, 940
See application file for complete search history.

(56) References Cited

U.S. PATENT DOCUMENTS 4,906,201 A * 3/1990 Young et al. ..... 439/108
6,074,222 A * 6/2000 Kuo ..... 439/92
6,364,707 B1 * 4/2002 Wang ..... 439/607

* cited by examiner

*Primary Examiner*—Phuong Dinh

(57) ABSTRACT

The present invention discloses a shield and an electrical connector with the shield. The shield has elastic slices each having a first bending portion, a second bending portion and a pressing portion. The first bending portion has a first horizontal portion flexed horizontally and outwardly, a first vertical portion flexed vertically and downwardly and a first corner connecting therebetween. The second bending portion has a second horizontal portion flexed horizontally and outwardly, a second vertical portion flexed vertically and upwardly and a second corner connecting therebetween. The pressing portion is extended from the upper part of the second vertical portion. When the electrical connector is assembled with an outside electrical device, the pressing portions of the elastic slices prop against the outside electrical device. Constructed as mentioned above, the elastic slices distribute stress generated by the propping action on the down left inner portions of the first corners and on up left inner portions of the second corners. Therefore the shield of the present invention can disperse stress effectively. Accordingly, the shield is prevented from being destroyed.

4 Claims, 5 Drawing Sheets

SHIELD AND ELECTRICAL CONNECTOR WITH THE SHIELD

BACKGROUND OF THE INVENTION

1. Field of the Invention

The present invention relates to a shield and an electrical connector with the shield, especially relates to a shield with elastic slices to prop over an outside electrical device.

2. The Related Art

Electrical connectors are widely applied in many industry fields. Electrical connectors are used to connect different electrical devices to make the electrical devices electrically connected.

FIG. 4 illustrates a conventional electrical connector 200, which comprises an insulated shell 60 having a plurality of terminals 70 received therein and a shield 80 wrapped outside thereof. A pair of side elastic slices 81 is flexed outwardly from the front part of both sides of the shield 80. A plurality of front spring pieces 82 is flexed upwardly from the top face of the shield 80. The side elastic slices 81 and the front spring pieces 82 are used to prop an outside electrical device to make the electrical connector 200 connecting ground.

Please refer to FIG. 5. Each side elastic slice 81 is firstly flexed horizontally outwardly and then flexed upwardly from the front part of a side face of the shield 80. Each side elastic slice 81 comprises a horizontal portion 811, a vertical portion 813 and a corner 812 connected therebetween. A V-shaped pressing portion 814 is extended from the upper part of the vertical portion 813.

When the electrical connector 200 is assembled with an outside electrical device, the pressing portions 814 of the shield 80 prop against the outside electrical device, therefore stress concentrates on the corner 812 of each side elastic slice 81. Accordingly, the side elastic slices 81 cannot effectively disperse stress so that the side elastic slices 81 are easy to become ineffective.

SUMMARY OF THE INVENTION

An object of the present invention is to provide a shield with especially constructed elastic slices to overcome the above-mentioned drawbacks. The elastic slices are able to effectively disperse stress generated thereon when the elastic slices are urged against an outside electrical device. Therefore the elastic slices can be prevented from being destroyed.

Another object of the present invention is to provide an electrical connector with a shield. The shield has elastic slices constructed to be able to effectively disperse stress generated thereon when the elastic slices are urged against an outside electrical device. Therefore the elastic slices can be prevented from being destroyed.

In order to accomplish the first object of the invention, the present invention provides a shield having:

an inner space formed therein;

elastic slices being flexed outwardly from the front part of the shield far away from the inner space, each elastic slice having a first bending portion, a second bending portion and a pressing portion;

the first bending portion being firstly flexed horizontally and outwardly to form a first horizontal portion and then flexed vertically and downwardly to form a first vertical portion, a first corner connecting the first horizontal portion and the first vertical portion;

the second bending portion being firstly flexed horizontally and outwardly from the end of the first vertical portion to form a second horizontal portion and then flexed vertically and upwardly to form a second vertical portion, a second corner connecting the second horizontal portion and the second vertical portion; and the pressing portion being extended from the upper part of the second vertical portion.

In order to accomplish the second object of the invention, the present invention provides an electrical connector including:

a plurality of terminals received in the connector; and a shield covering the electrical connector, the shield having:

an inner space formed therein;

elastic slices being flexed outwardly from the front part of the shield far away from the inner space, each elastic slice having a first bending portion, a second bending portion and a pressing portion;

the first bending portion being firstly flexed horizontally and outwardly to form a first horizontal portion and then flexed vertically and downwardly to form a first vertical portion, a first corner connecting the first horizontal portion and the first vertical portion;

the second bending portion being firstly flexed horizontally and outwardly from the end of the first vertical portion to form a second horizontal portion and then flexed vertically and upwardly to form a second vertical portion, a second corner connecting the second horizontal portion and the second vertical portion; and the pressing portion being extended from the upper part of the second vertical portion.

When the electrical connector is assembled with an outside electrical device, the pressing portions of the elastic slices prop against the outside electrical device. Constructed as mentioned above, the elastic slices distribute stress generated by the propping action on the down left inner portions of the first corners and on up left inner portions of the second corners. Comparing with the prior art, the shield of the present invention can disperse stress effectively. Therefore the shield is prevented from being destroyed.

DETAILED DESCRIPTION OF THE PREFERRED EMBODIMENT

Figure 1:
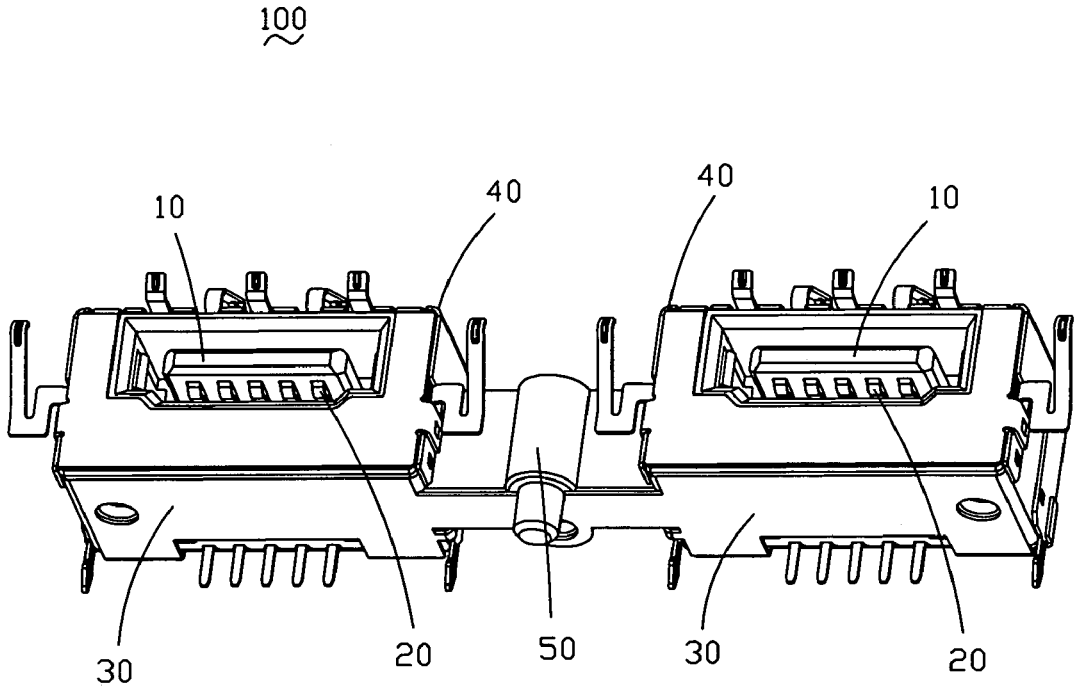
FIG. 1 is a perspective view of an electrical connector of the present invention.

An electrical connector 100 with a shield 30 of the present invention is shown in FIG. 1. The electrical connector 100 comprises a pair of housings 40. The two housings 40 are connected by a rectangular pillar portion 50 therebetween. Each housing 40 includes an insulated shell 10 with a plurality of terminals 20 received therein and a shield 30 covering thereon.

Figure 2:
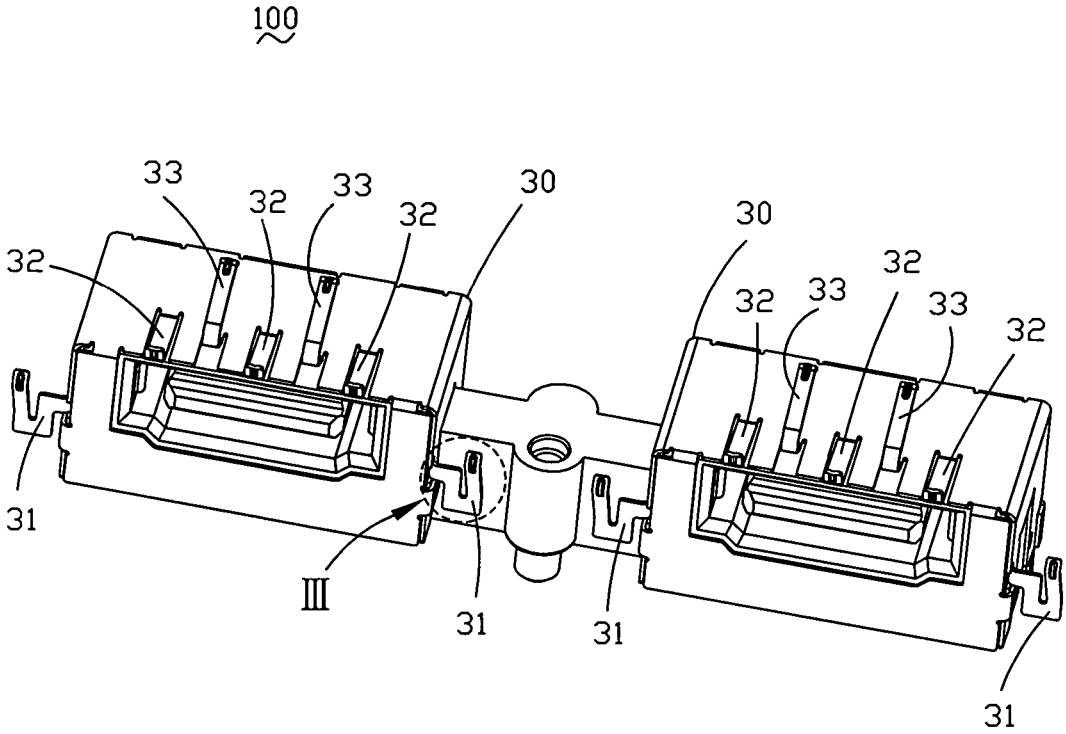
FIG. 2 is another perspective view of the electrical connector of FIG. 1.

Please refer to FIG. 2. Each shield 30 has a top face, a bottom face and two side faces, which define an inner space therebetween. A pair of elastic slices 31 is extended far away from the inner space of each shield 30 in front of the two side faces of each shield 30. Three front spring pieces 32 and two back spring pieces 33 are flexed upwardly from the top face of each shield 30, wherein each front spring piece 32 is flexed forwardly with a small angle of inclination and each back spring piece 33 is flexed backwardly with a big angle of inclination. The front spring pieces 32 and the back spring pieces 33 are separated with each other. The elastic slices 31 and the spring pieces 32, 33 are urged against an outside electrical device when the electrical connector 100 is assembled with the outside electrical device, thereby grounding the electrical connector 100.

Figure 3:
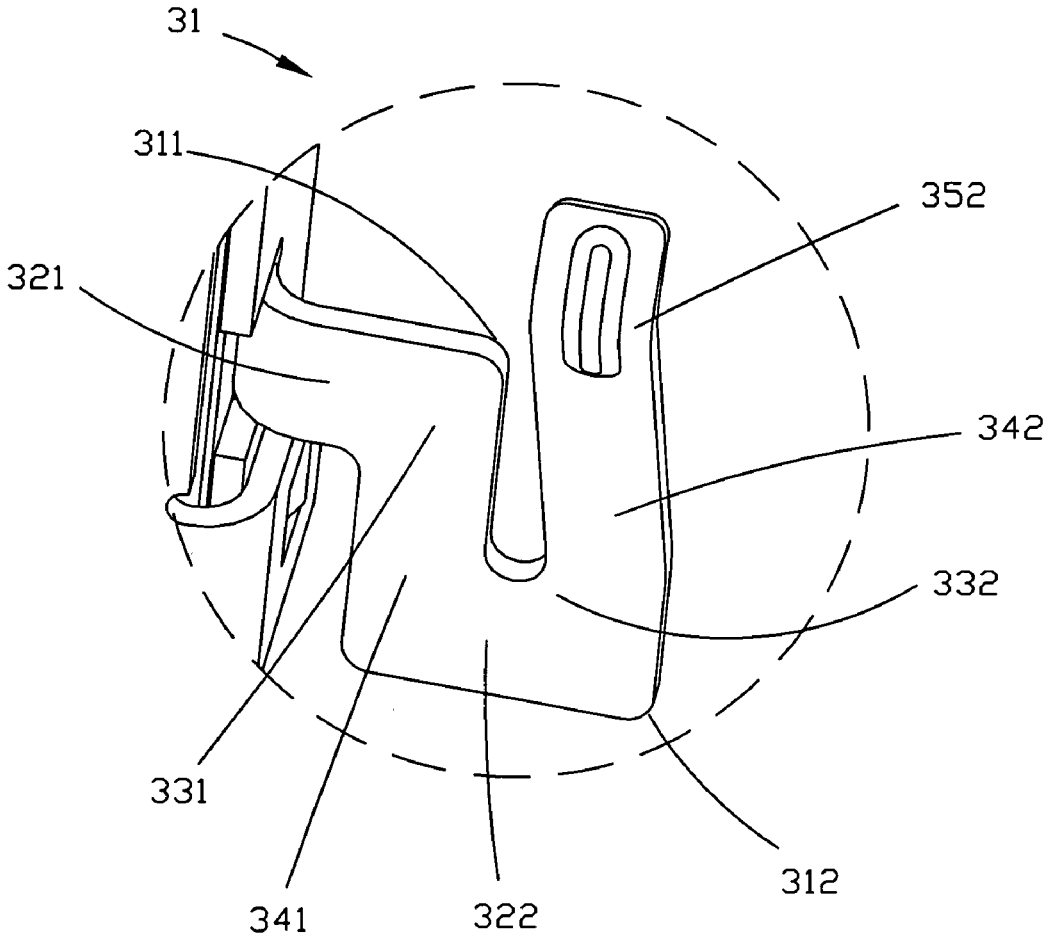
FIG. 3 is a partially enlarged view of the encircled portion labeled III of FIG. 2.
Figure 4:
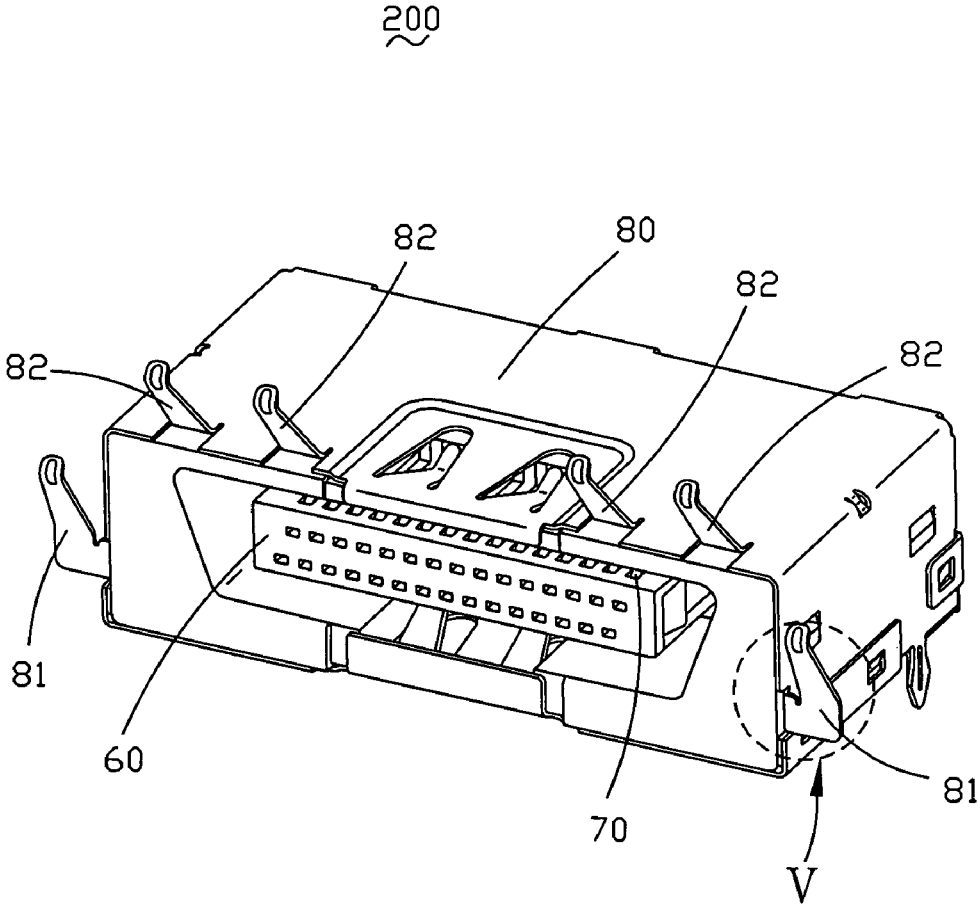
( PRIOR ART ) FIG. 4
FIG. 4 is a perspective view of a conventional electrical connector.
Figure 5:
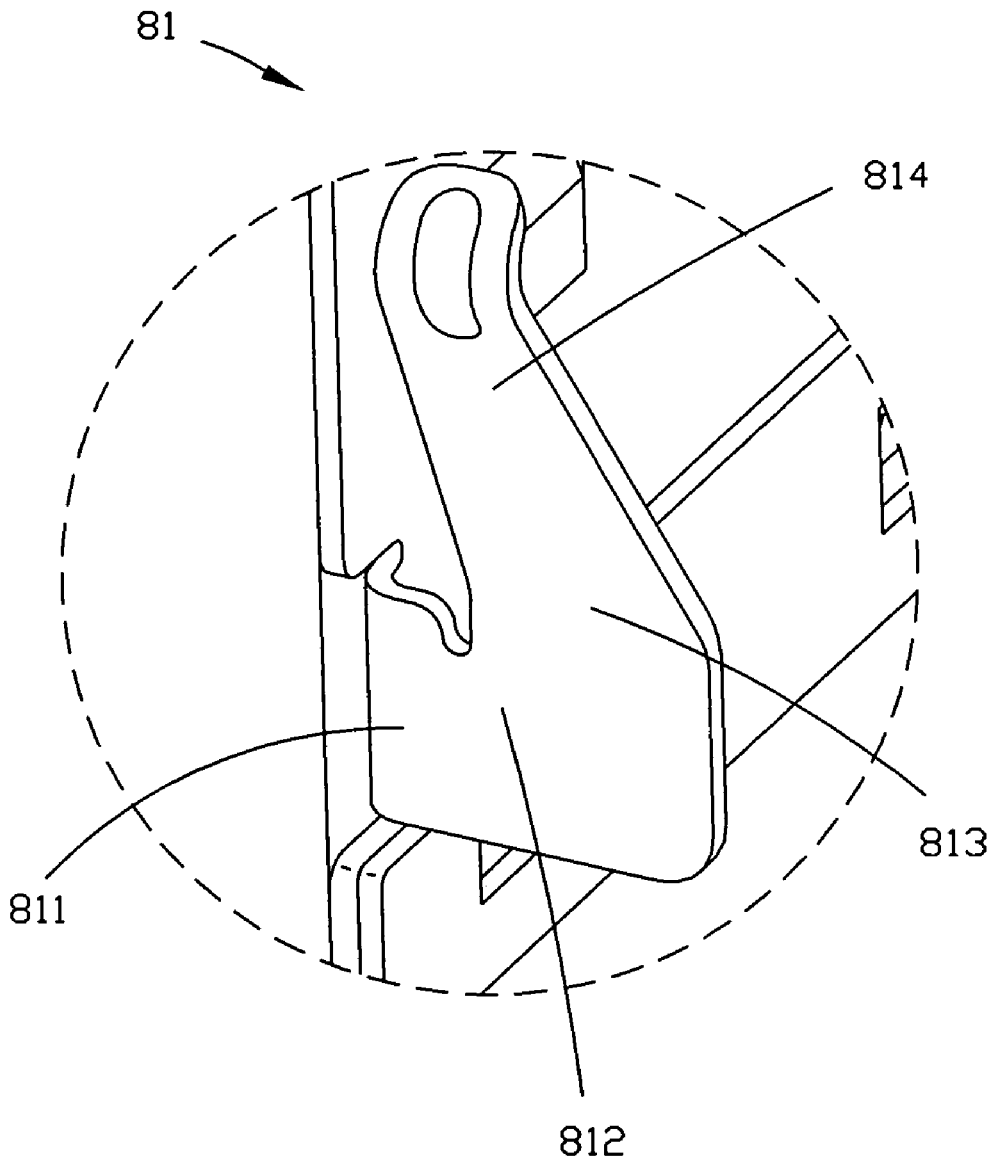
( PRIOR ART ) FIG. 5
FIG. 5 is a partially enlarged view of the encircled portion labeled V of FIG. 4.

Referring to FIG. 3, each elastic slice 31 is flexed from one side face of the shield 30. Each elastic slice 31 has a first bending portion 311, a second bending portion 312 and a pressing portion 352. The first bending portion 311 is firstly flexed horizontally and outwardly from the front part of the side face to form a first horizontal portion 321, and then flexed vertically and downwardly to form a first vertical portion 341. The first bending portion 311 further has a first corner 331 connecting the first horizontal portion 321 and the first vertical portion 341. The first bending portion 311 is about flush with the front surface of the shield 30. The second bending portion 312 is firstly flexed horizontally and outwardly from the end of the first vertical portion 341 to from a second horizontal portion 322, and then flexed vertically and upwardly to form a second vertical portion 342. The second bending portion 312 further has a second corner 332 connecting the second horizontal portion 322 and the second vertical portion 342. The pressing portion 352, which is V-shaped, is extended from the upper part of the second vertical portion 342.

When the electrical connector 100 is assembled with an outside electrical device, the pressing portions 352 of the elastic slices 31 prop against the outside electrical device, during which stress is generated on the elastic slices 31 due to the propping action. Constructed as mentioned above, the elastic slices 31 distribute the stress on the down left inner portions of the first corners 331 of the first bending portions 311 and on up left inner portions of the second corners 332 of the second bending portions 312. Comparing with the prior art whose stress is concentrated on only one corner, the electrical connector 100 according to the present invention can disperse stress effectively. Therefore the elastic slices 31 are prevented from being destroyed.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

What is claimed is:

1. A shield adapted to shield an electrical connector comprising:

a top face, a bottom face and two side faces defining an inner space therein;

elastic slices being flexed outwardly from the front part of the shield far away from the inner space, each elastic slice having a first bending portion, a second bending portion and a pressing portion;

said first bending portion being firstly flexed horizontally and outwardly to form a first horizontal portion and then flexed vertically and downwardly to form a first vertical portion, a first corner connecting the first horizontal portion and the first vertical portion;

said second bending portion being firstly flexed horizontally and outwardly from the end of the first vertical portion to form a second horizontal portion and then flexed vertically and upwardly to form a second vertical portion, a second corner connecting the second horizontal portion and the second vertical portion; and said pressing portion being extended from the upper part of said second vertical portion;

wherein said first bending portion of said elastic slice is flexed from the front part of the side face of said shield, and said pressing portion of said elastic slice is V-shaped.

2. The shield as claimed in claim 1, further having a plurality of front spring pieces and a plurality of back spring pieces, wherein said front spring pieces arc flexed upwardly and forwardly from the top face of said shield, said back spring pieces are flexed upwardly and backwardly from the top face of said shield.

3. An electrical connector comprising:

a plurality of terminals received in the connector; and a shield covering the electrical connector, the shield having:

a top face, a bottom face and two side faces defining an inner space therein;

elastic slices being flexed outwardly from the front part of the shield far away from the inner space, each elastic slice having a first bending portion, a second bending portion and a pressing portion;

said first bending portion being firstly flexed horizontally and outwardly to form a first horizontal portion and then flexed vertically and downwardly to form a first vertical portion, a first corner connecting the first horizontal portion and the first vertical portion;

said second bending portion being firstly flexed horizontally and outwardly form the end of the first vertical portion to form a second horizontal portion and then flexed vertically and upwardly to form a second vertical portion, a second corner connecting the second horizontal portion and the second vertical portion; and said pressing portion being extended from the upper part of said second vertical portion;

wherein said first bending portion of said elastic slice is flexed from the front part of the side face of said shield, and said pressing portion of said elastic slice is V-shaped.

4. The electrical connector as claimed in claim 3, wherein said shield further has a plurality of front spring pieces and a plurality of back spring pieces, said front spring pieces are flexed upwardly and forwardly from the top face of said shield, said back spring pieces are flexed upwardly and backwardly from the top face of said shield.

* * * * *